US007121642B2

(12) United States Patent
Stoessel et al.

(10) Patent No.: US 7,121,642 B2
(45) Date of Patent: Oct. 17, 2006

(54) DROP VOLUME MEASUREMENT AND CONTROL FOR INK JET PRINTING

(75) Inventors: Matthias Stoessel, Mannheim (DE); Karl Pichler, Santa Clara, CA (US)

(73) Assignee: Osram Opto Semiconductors GmbH, Regensburg (DE)

( * ) Notice: Subject to any disclaimer, the term of this patent is extended or adjusted under 35 U.S.C. 154(b) by 65 days.

(21) Appl. No.: 10/214,024

(22) Filed: Aug. 7, 2002

(65) Prior Publication Data

US 2004/0027405 A1 Feb. 12, 2004

(51) Int. Cl.
*B41J 29/393* (2006.01)

(52) U.S. Cl. ..... 347/19; 347/81; 347/14

(58) Field of Classification Search ..... 347/19, 347/81, 5, 14, 12, 42, 9
See application file for complete search history.

(56) References Cited

U.S. PATENT DOCUMENTS

| | | | | |
|---|---|---|---|---|
| 5,160,939 | A * | 11/1992 | Bajeux et al. | 347/78 |
| 6,315,383 | B1 * | 11/2001 | Sarmast et al. | 347/19 |
| 6,513,901 | B1 * | 2/2003 | Walker | 347/19 |
| 6,655,775 | B1 * | 12/2003 | Raman et al. | 347/19 |
| 6,764,168 | B1 * | 7/2004 | Meinhold et al. | 347/81 |
| 2003/0160838 | A1 * | 8/2003 | Su et al. | 347/19 |
| 2004/0009304 | A1 | 1/2004 | Pichler et al. | 427/551 |

OTHER PUBLICATIONS

Litrex 142 [online]. Litrex Corporation, 2006 [retrieved on Mar. 2, 2006]. Retrieved from the Internet: <URL: http://www.litrex.com/pdf/products/142-data-sheet.pdf>, 2 pp.

Xennia [online]. Xennia Technology Limited, 2006 [retrieved on Mar. 3, 2006]. Retrieved from the Internet: <URL: http://eh0643.empetushosting.net/news/article.asp?ItemID=2, http://eh0643.empetushosting.net/capabilities/, 2 pp.

T.R. Hebner et al., "Ink-jet printing of doped polymers for organic light emitting devices", 1998, American Institute of Physics, pp. 519-521.

M.A. Lampert et al., "Current Injection in Solids", 1970, Academic Press, New York and London, pp. 3-111.

Stephen F. Pond, Ph.D., "Inkjet Technology and Product Development Strategies", 2000, Torrey Pines Research, Carlsbad, California, pp. 83-151, 227-270, 367-405.

Paul Horowitz et al., "The Art of Electronics", Second Edition, 1989, Cambridge University Press, pp. 175-261, 863-915, 987-1041.

* cited by examiner

*Primary Examiner*—Manish S. Shah
*Assistant Examiner*—Lam S. Ngyuen
(74) *Attorney, Agent, or Firm*—Fish & Richardson P.C.

(57) ABSTRACT

A system and method is presented for measuring the volume of an ink-jet droplet or the relative volumes of a plurality of ink-jet droplets using their electrical properties. In a preferred embodiment a single small capacitor or an array of capacitors is used to measure the dielectric properties of ink-jet droplets and the absolute drop volumes are derived. In an alternative preferred embodiment the relative differences in drop volumes are determined. A feedback circuit, such as one using lock-in technique, may be used to automatically adjust subsequent drop volumes.

24 Claims, 10 Drawing Sheets

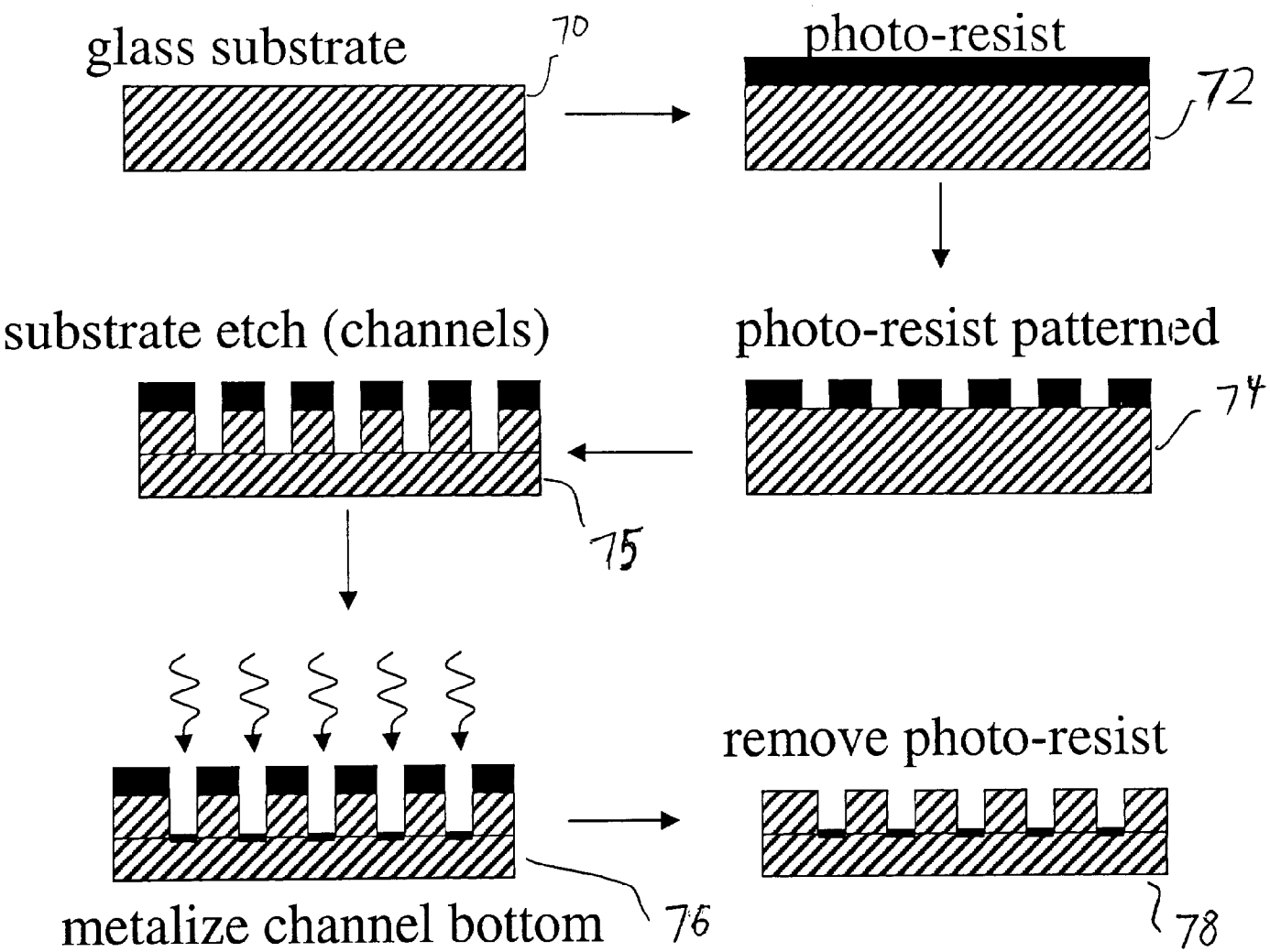
Fig. 7a: first electrode plate

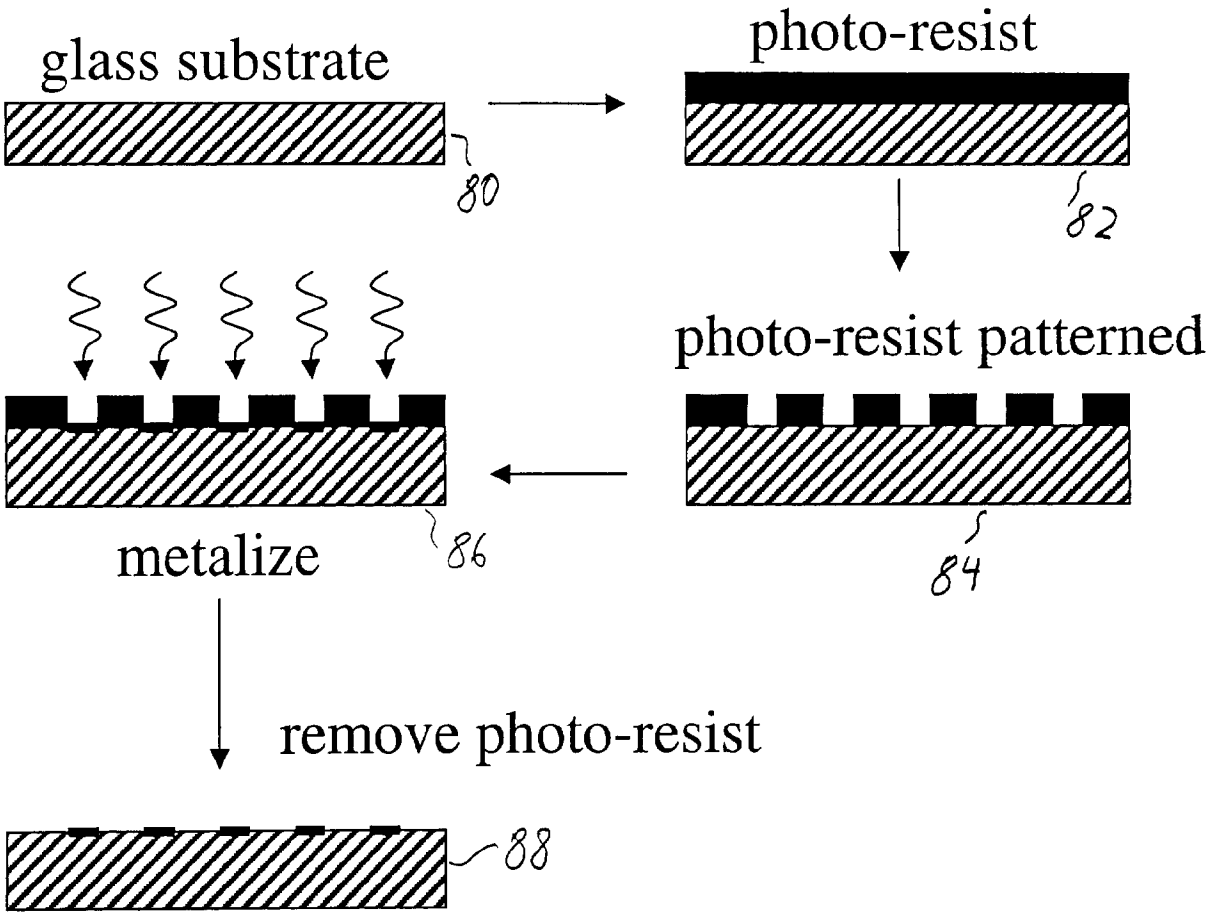
Fig. 7b: second electrode plate

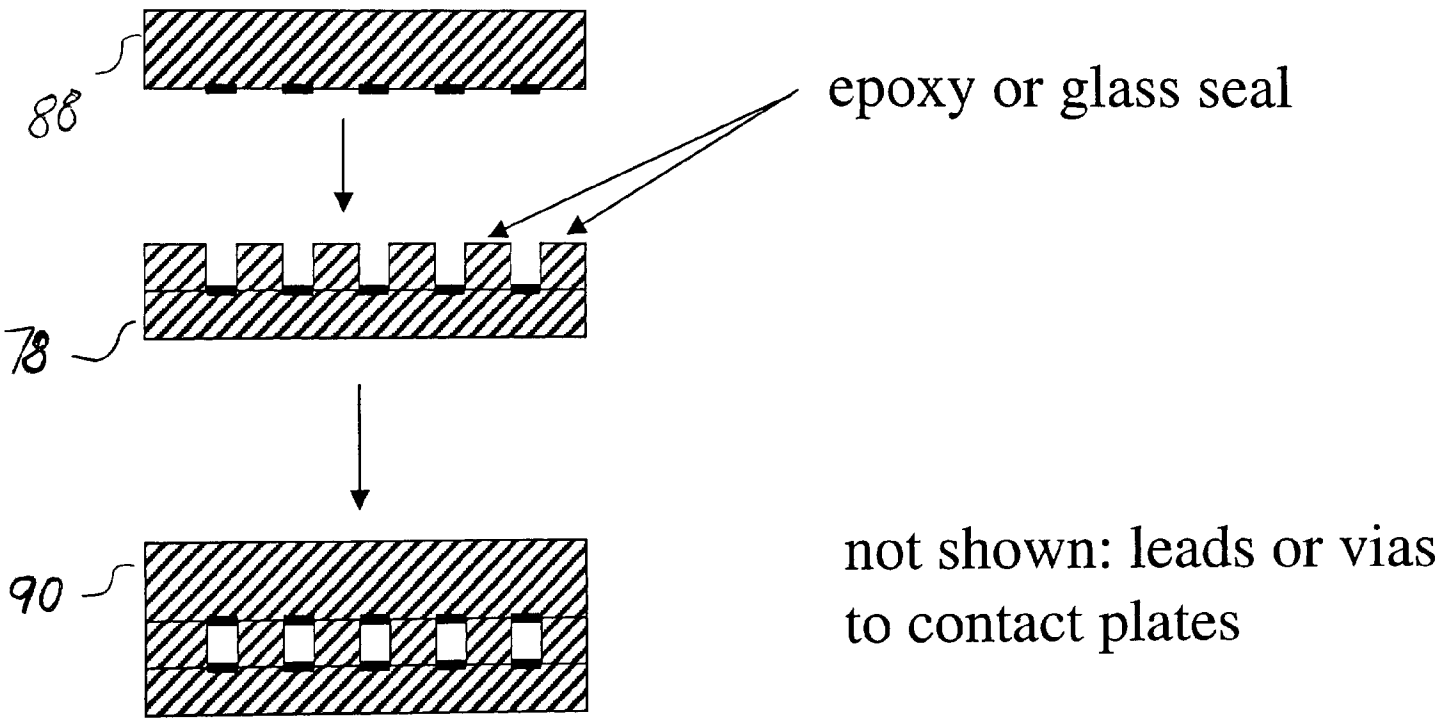
Fig. 7c: assembly of electrode plates:

DROP VOLUME MEASUREMENT AND CONTROL FOR INK JET PRINTING

BACKGROUND OF THE INVENTION

1. Field of the Invention

The present invention relates to a drop volume measurement and control mechanism and process for inkjet printing. More particularly, the present invention relates to the measurement of an electrical property of an ink-jet droplet, such as its dielectric properties, to determine its volume.

2. Description of Related Art

One conventional type of printer forms characters and images on a medium or substrate, such as paper, by expelling droplets of ink, often comprising organic material, in a controlled fashion so that the droplets land on the medium in a pattern. Such a printer can be conceptualized as a mechanism for moving and placing the medium in a position such that ink droplets can be placed on the medium, a printing cartridge which controls the flow of ink and expels droplets of ink to the medium, and appropriate control hardware and software. A conventional print cartridge for an inkjet type printer comprises an ink containment device and a fingernail-sized apparatus, commonly known as a print head, which heats and expels ink droplets in a controlled fashion. The print cartridge may contain a storage vessel for ink, or the storage vessel may be separate from the print head. Other conventional inkjet type printers use piezo elements that can vary the ink chamber volume through use of the piezo-electric effect to expel ink droplets in a controlled fashion. Helpful background material may be found in U.S. patent application Ser. No. 10/191,911, entitled "Process And Tool With Energy Source For Fabrication Of Organic Electronic Devices", which is incorporated herein by reference.

Ink jet printing is a relatively new technique for deposition of polymer solutions to create organic electronics (by way of example only, organic integrated circuit boards, thin film transistors, detectors, solar cells, displays based on light-emitting polymers). Other applications of ink jet printing include, by way of example only, ink-jet printing of color filter arrays such as OLEDs and LCD displays, printing of metal solutions/suspensions to create conductive/metal lines, and printing of materials for biomedical or biochemical applications and devices. In a typical application, polymers, monomers, and/or oligomers are dissolved or dispersed in appropriate solvents and are deposited onto appropriate substrates by an ink jet printing process. The solutions dry and form thin solid films on these substrates. For organic light-emitting devices (OLEDs), the thickness of these films is often measured in nanometers. Unintentional thickness variations and inhomogeneities may cause major defects in the end product. For example, in many circuit elements, current is roughly inversely proportional to the film thickness cubed. Thus, small thickness variations often cause unacceptable variations in current for the same driving voltage. Since the light output for OLEDs is approximately proportional to the current, variation in the thickness can create significant variation in the light output. If the film thickness needs to be within a certain range (such as a tolerance of ±5%), the volume of droplets ejected from ink jet nozzles has to be restricted to a similar tolerance.

Although drop volume must be carefully controlled for the creation of organic electronics using ink jet nozzles, drop volume is also an important consideration for other dispensing devices. By way of example only, ink jet printers for graphic arts or printers used for the creation of color filters for liquid crystal displays can also benefit from control of drop volume. Thus, dispensing devices for bio-chemistry and printing of polymeric integrated circuit boards are only some of the applications where drop volume is important. Piezo-based ink jet printing, thermal ink jet printing, micro-dosing, and micro-pipettes are just some of the types of dispensing devices that eject ink droplets.

"Off-line" methods exist to measure drop volume of ejected droplets. One method is to eject a defined number of droplets into a container and, using the weight of the resulting ejected droplets (or the resulting dried film/drop material) along with the known density, calculating the average drop volume. Helpful background material may be found in various publications, such as, by way of example only, S. F. Pond: "Inkjet Technology", Torrey Pines Research (2000).

Disadvantageously, the off-line method, as the name implies, requires that the particular dispenser or dispensers being tested are taken out of use while being tested. The interruption of the printing process and the time consumption involved during testing can mean a significant decrease in productivity. Additionally, if there is more than one nozzle, each nozzle must be tested separately, and so it is not efficient to perform a determination of drop volume variation between nozzles. Furthermore, the evaporation of solvents in the droplets between the time the droplets leave the nozzle and the moment they are weighed can skew the results of the test.

Optical methods tend to be more sophisticated than the "off-line" method described above. Stroboscopic illumination of droplets may be used to take pictures of droplets during flight, and the drop diameter and drop volume are calculated from these images. Laser measurements can be used to determine the drop volume by measuring the length of time a laser beam is blocked by the droplet and, using that information along with the drop velocity measurements, calculating the drop diameter.

Disadvantageously, stroboscopic measurement is inaccurate. The visible border of a given droplet strongly depends on the illumination, camera settings, and other technical variations, making the results unreliable for many applications.

Laser measurements are generally more precise than stroboscopic measurements, but are also time-consuming and expensive. Furthermore, the optical components (such as mirrors, lenses, light-sources) used for laser measurements may be too bulky for a given application. The bulkiness of components is especially disadvantageous when attempting to implement a plurality of detectors that are capable of scanning a plurality of nozzles simultaneously. Additionally, the laser source may introduce laser hazards. Finally, liquid droplets having different components may have different absorption of light, thereby skewing the results.

Optical methods are also susceptible to being compromised by ink splashes and/or dirt in the environment. In the "dirty" environment of printing, the performance of optical sensors can be compromised, necessitating frequent cleaning and/or replacement of parts.

SUMMARY OF THE INVENTION

It is therefore an object of the present invention to provide a process and tool to measure an electrical property of an ink-jet droplet or a plurality of droplets.

It is another object of the present invention to determine the volume of an ink-jet droplet or a plurality of droplets from the dielectric properties of the ink-jet droplet or droplets.

It is yet another object of the present invention to measure properties of ink-jet droplets for the purpose of determining the relative differences in the volumes of the ink-jet droplets via their dielectric properties.

It is yet another object of the present invention to provide a process and tool for a control mechanism that uses the measurement of the dielectrical properties of ink-jet droplets or an array of droplets as feedback for adjusting the volume of subsequent ink-jet droplets.

An electrical circuit is used to measure the volume of an ink-jet droplet or the relative volumes of a plurality of ink-jet droplets. In a preferred embodiment a single small capacitor or an array of capacitors is used to measure the dielectric effect of ink-jet droplets and the absolute drop volumes are derived using additional information such as, by way of example only, the typical dielectric constant of the material forming the droplet. In an alternative preferred embodiment the relative differences in drop volumes are determined. A feedback circuit may be used to automatically adjust subsequent drop volumes, for example by adjusting the piezo voltage and/or voltage pulse-shape and/or duration and/or pulse sequence applied to a given piezo-electric nozzle.

BRIEF DESCRIPTION OF THE DRAWINGS

FIG. 7*a* is a flow diagram showing steps to manufacture a set of first electrode plates for multiple capacitor sensors that may be used to scan droplets emitted from an array of print nozzles.

FIG. 7*b* is a flow diagram showing steps to manufacture a set of second electrode plates for multiple capacitor sensors that may be used to scan droplets emitted from an array of print nozzles.

FIG. 7*c* is a flow diagram showing steps to assemble multiple capacitor sensors that may be used to scan droplets emitted from an array of print nozzles.

DETAILED DESCRIPTION

In a preferred embodiment, the invention is described in an implementation for the application of circuit and/or display components on substrates. The invention may be, in other preferred embodiments, implemented for other purposes, where drop volume is important in the application of droplets onto a surface. In a preferred embodiment described herein, the dielectric effect of such droplets is measured by an electrical circuit. In alternative preferred embodiments, other electrical/magnetic characteristics of droplets, such as resistance, electrical charge, or magnetic properties are measured.

Figure 1:
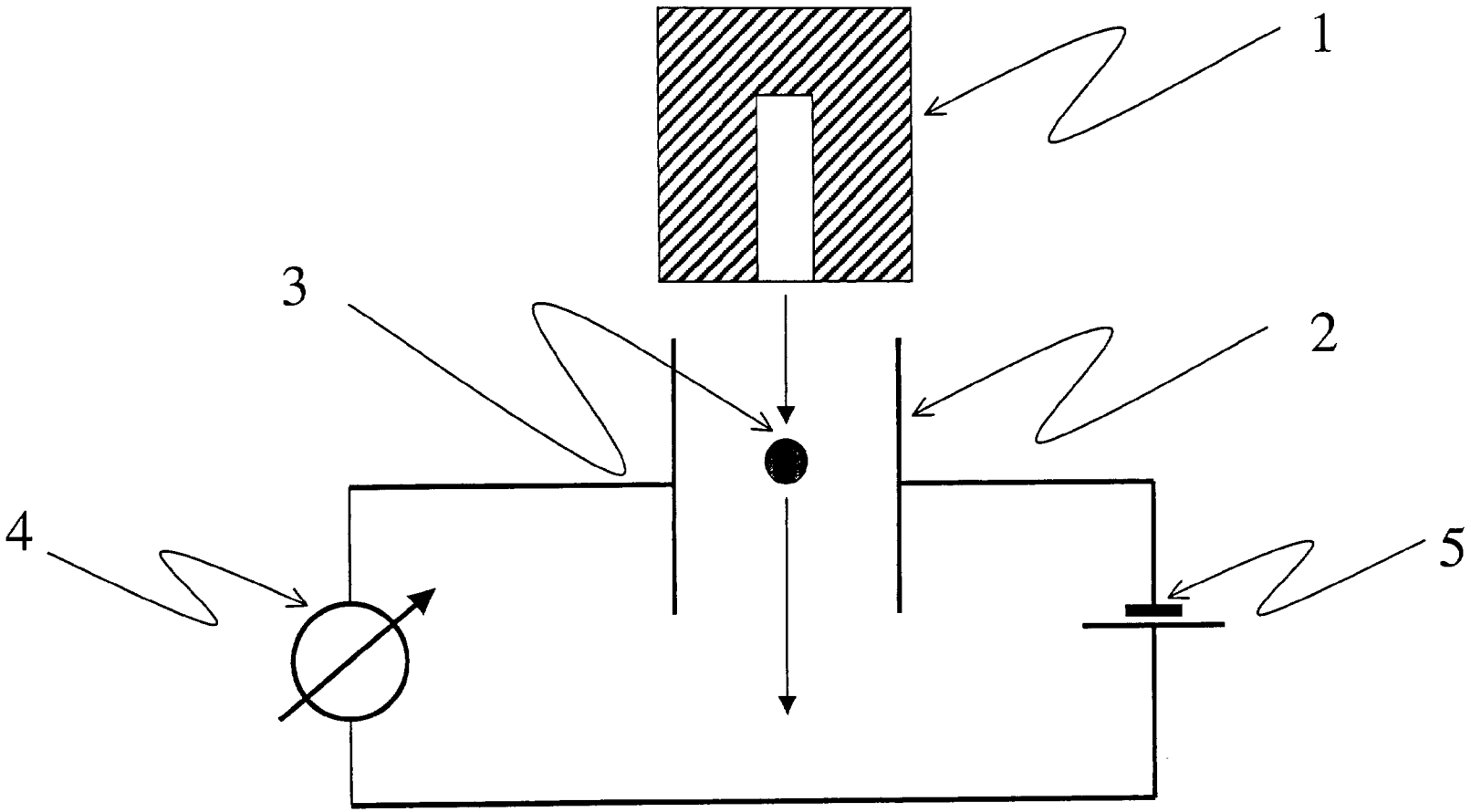
FIG. 1 is a diagram showing the use of a parallel plate capacitor in an apparatus that detects the change in capacitance of the capacitor due to the dielectric effect of an ink-jet droplet.

With reference to FIG. 1, a preferred embodiment of the invention is shown. Print head 1 for the purpose of this specification is any device that emits a liquid in a controlled fashion, using, by way of example only, a printing nozzle, printing plate, or dispensing nozzle. In a preferred embodiment shown in FIG. 1, print head 1 has a single nozzle.

Print head 1 emits, through capacitor 2, liquid droplet 3. In a preferred embodiment this is accomplished by way of drop-on-demand ink-jet printing (such as bubblejet, piezo-electric, electrostatic or other), though in alternative preferred embodiments other ink-jet printing technology may be used, such as micro-dispensing, by way of example only.

Current meter 4 measures the current flow through a circuit comprising capacitor 2, current meter 4, and power source 5. In a preferred embodiment, power supply 5 is a constant voltage source. When liquid droplet 3 passes through capacitor 2, the dielectric properties of liquid droplet 3 causes a change in the capacitance of capacitor 2, thereby changing the current in the circuit. Current meter 4 detects the change in current, and a processing circuit and/or microprocessor (not shown) may be used to translate the change in current into drop volume.

Figure 2:
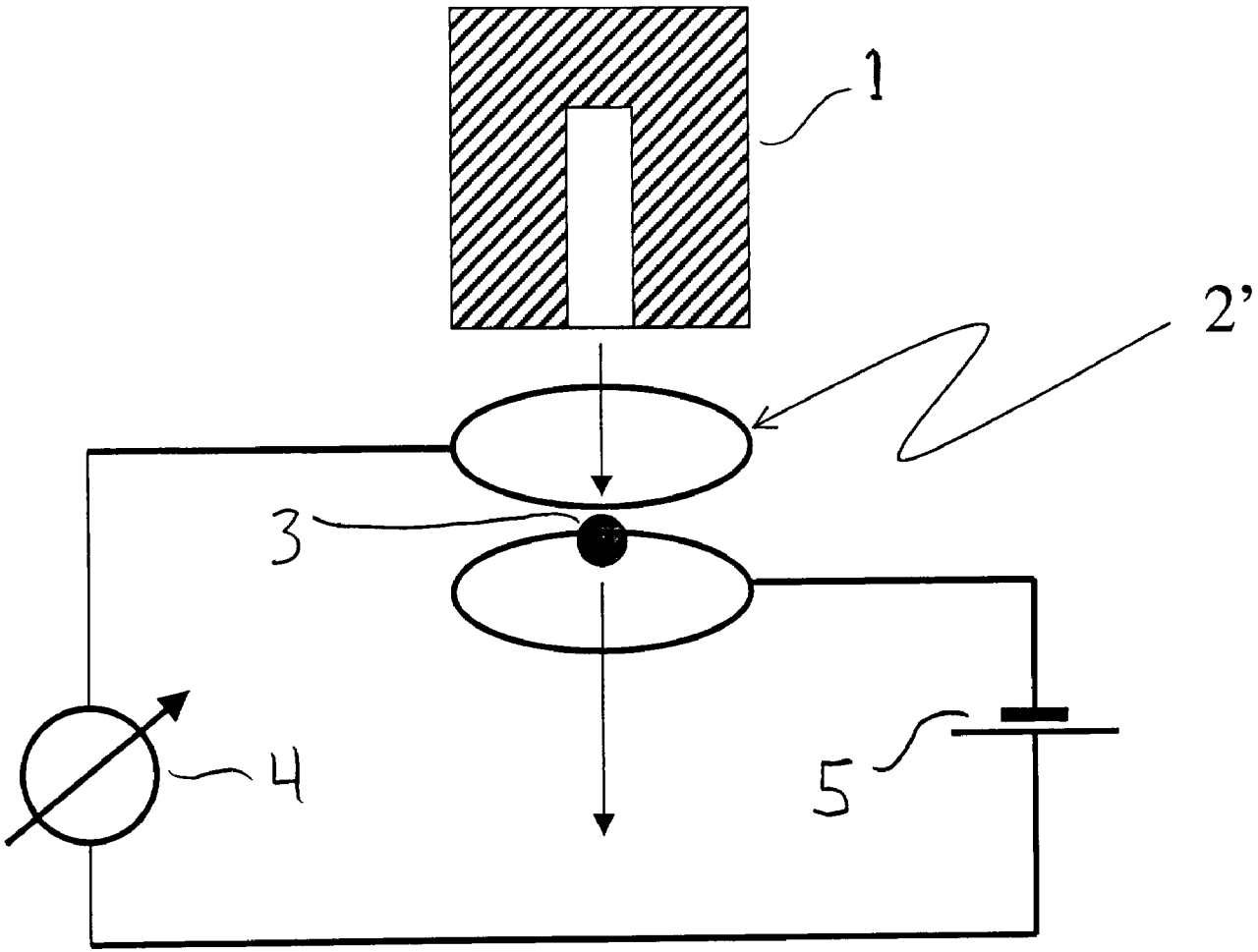
FIG. 2 is a diagram showing the use of a ring capacitor in an apparatus that detects the change in capacitance of the capacitor due to the dielectric effect of an ink-jet droplet.

In a preferred embodiment shown in FIG. 1, capacitor 2 is a parallel plate capacitor. Other types of capacitors may be used in alternative preferred embodiments. By way of example only, ring capacitor 2' is shown in FIG. 2 as part of a similar circuit.

Figure 3:
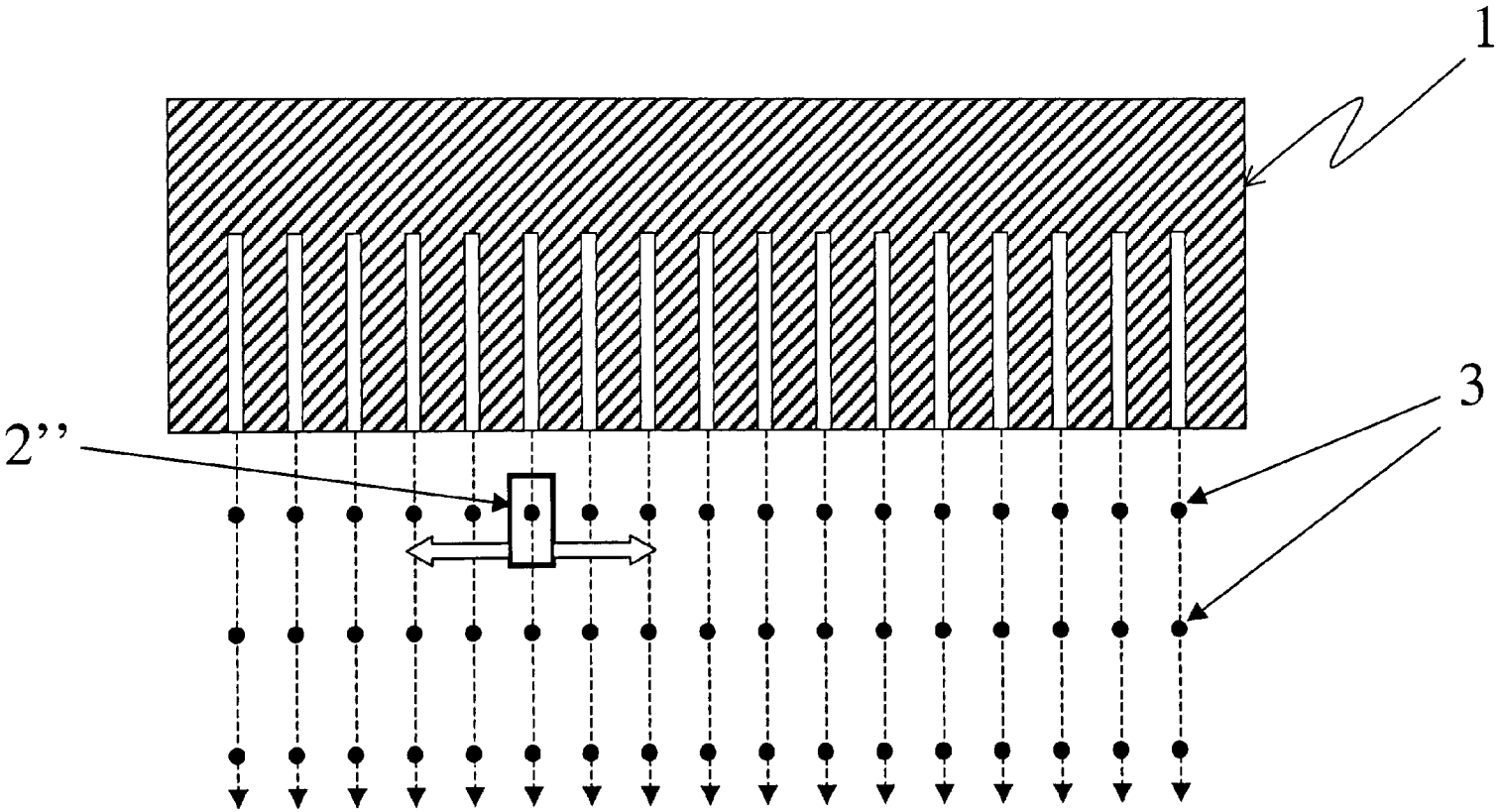
FIG. 3 is a diagram showing a single capacitor sensor being used to scan droplets emitted from an array of print nozzles.

With reference to FIG. 3, an alternative preferred embodiment is shown where print head 1' has multiple nozzles. Capacitor 2", which in a preferred embodiment has the same electrical properties as capacitor 2 in FIG. 1, moves relative to print head 1'. In an alternative preferred embodiment, capacitor 2" is stationary while print head 1' moves. Using a controller (not shown), capacitor 2" is aligned with each nozzle of print head 1' sequentially. Capacitor 2" may be used to scan multiple nozzles in this fashion. At each nozzle, one or more droplet 3 is allowed to pass through capacitor 2". The results for each nozzle may be compared with the results of one or more other nozzles. The drop volume for any nozzle may be adjusted according to these results. By way of example only, a process may be set up such that if the average drop volume of liquid droplets 3 out of a particular nozzle deviates by more than 5% from the average of the other nozzles, the parameters of the deviant nozzle are adjusted (for example by adjusting the piezo voltage applied to the nozzle if the print head is of the piezo-electric type, or adjusting the voltage pulse-shape and/or duration and/or pulse sequence applied).

Figure 4:
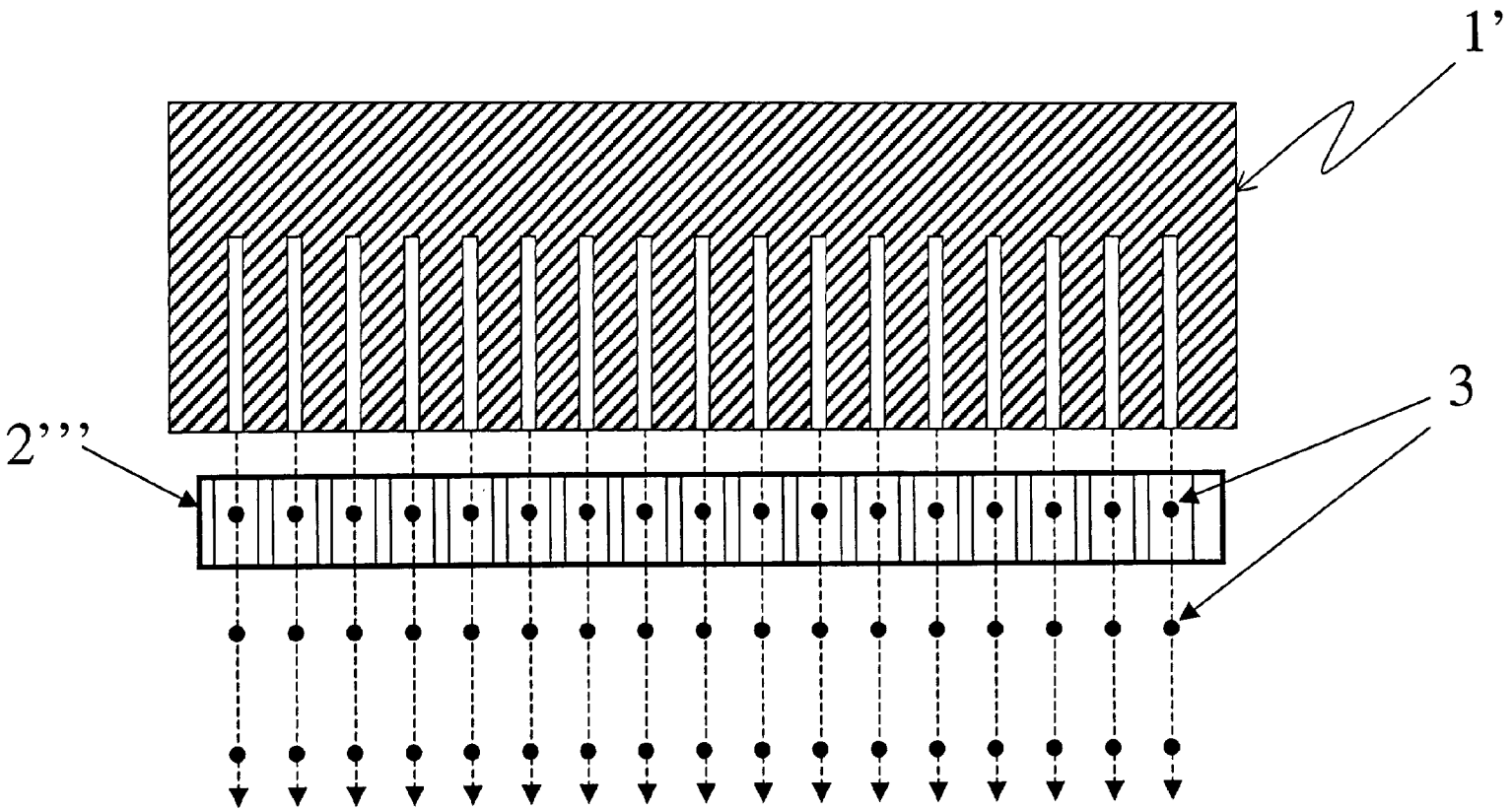
FIG. 4 is a diagram showing multiple capacitor sensors being used to scan droplets emitted from an array of print nozzles.

An alternative preferred embodiment is shown in FIG. 4 where multiple capacitor sensor 2''' allows the simultaneous measurement and/or comparison of the drop volumes of solution droplets 3 from multiple nozzles. A circuit, such as the one shown in FIG. 1, may be used for each capacitor within multiple capacitor sensor 2'''. Advantageously, multiple capacitor sensor 2''' does not need to be moved around to scan multiple nozzles, and can therefore be used to provide quicker measurements for a multiple nozzle system. In an alternative preferred embodiment, the number of sensors multiple capacitor sensor 2''' has is fewer than the number of nozzles in print head 1', and multiple capacitor sensor 2''' and print head 1' move relative to one another as described in FIG. 3 and the accompanying text. For example, multiple capacitor sensor 2''' might have 32 capacitors while print head 1' has 128 nozzles; in this case multiple capacitor sensor 2''' needs to be aligned with a subset of nozzles of print head 1' four times in order to scan all the nozzles.

Figure 5:
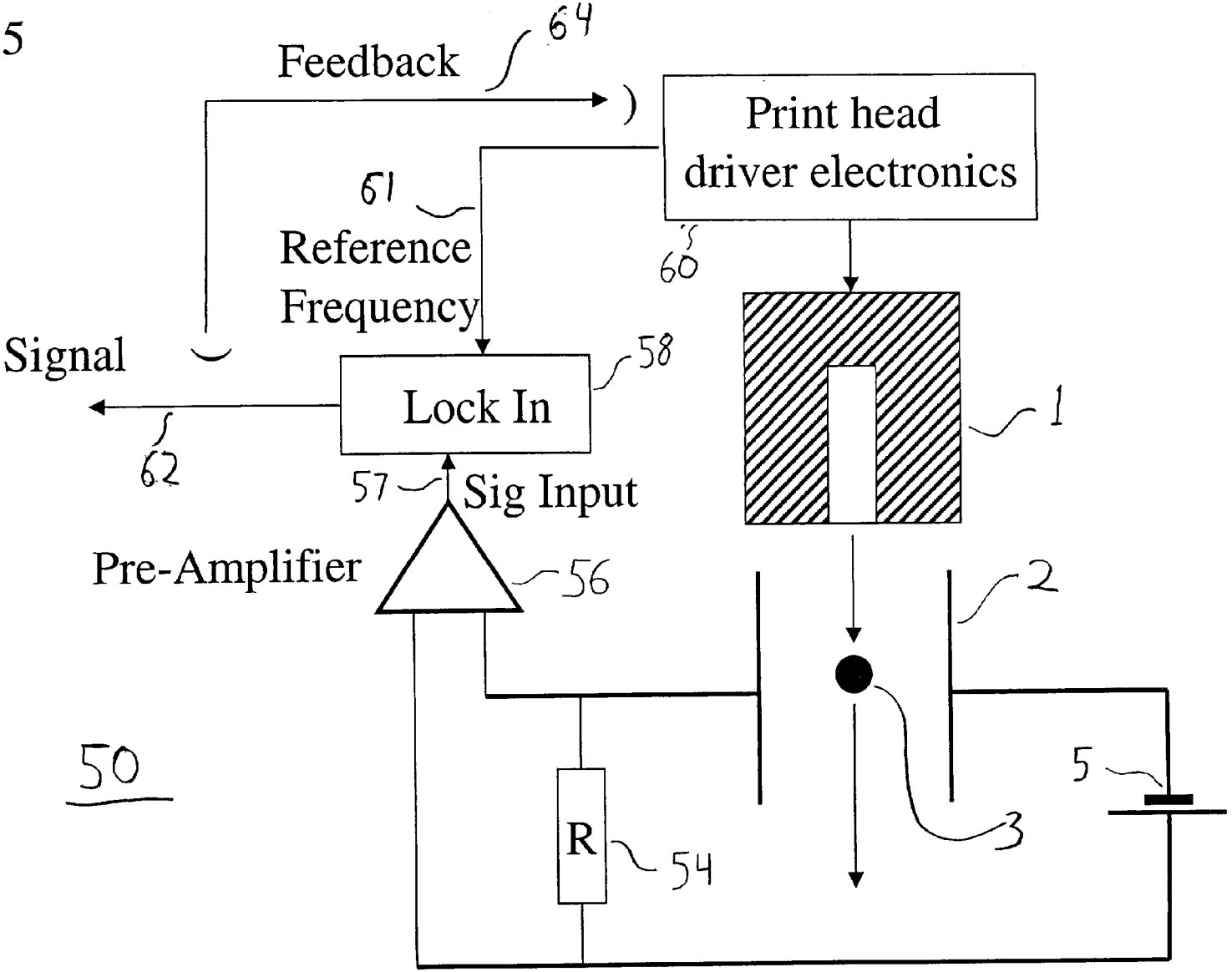
FIG. 5 is a diagram showing a feedback process using a lock-in amplifier for generating a desired drop volume.

Drop volume control, in a preferred embodiment, is based on changes in capacitance in combination with a lock-in technique. An example of a lock-in technique that uses the droplet ejection frequency of a print head is shown as circuit 50 in FIG. 5. Examples of lock-in techniques may be found in various publications, such as, by way of example only, P. Horowitz, W. Hill, *The Art of Electronics,* Cambridge University Press (1996), which is incorporated by reference to the extent not inconsistent with the present invention.

In a preferred embodiment, the current across resistor 54 is measured to determine the change in the charge over time on capacitor 2. The resulting signal is pre-amplified with low-noise amplifier 56 and fed as the input 57 into lock-in amplifier 58 (which can be, for example, the SR830, which includes low-noise amplifier 56 and is available from Stanford Research Systems, located in Sunnyvale, Calif.). Print head driver electronics 60 (which controls print head 1) can provide the reference clock signal 61 to lock-in amplifier 58. Output signal 62 of lock-in amplifier 58 may be used as a representation of the direct measurement of the average drop volume and can be sent through feedback loop 64 back to print head driver electronics 60 in order to automatically adjust the drop volume. Due to noise, there is typically a trade-off between the number of droplets sampled to obtain an average drop volume measurement and the accuracy of the measurement. In an alternative preferred embodiment, output signal 62 is used for adjusting the drop volume manually to a certain level.

Instead of calculating the drop volume from the measured output signal 62, an alternative calibration method may be applied. In this alternative calibration procedure, droplets 3 with various volumes are generated and output signal 62 is monitored to evaluate the relationship between output signal 62 and the drop volume experimentally. Other methods, such as gravimetric measurements by way of example only, may be used to calibrate output signal 62 with the drop volume.

It may be preferable to ensure that the droplets do not have a charge or at least have the same average amount of electric charge, to prevent electrical charges from skewing the results. In this alternative preferred embodiment, an ionizer or de-ionizer, ultraviolet light, or a device designed to "spray" electrical charge or to discharge/neutralize the droplets may be applied prior to the droplets entering the capacitor.

Figure 6:
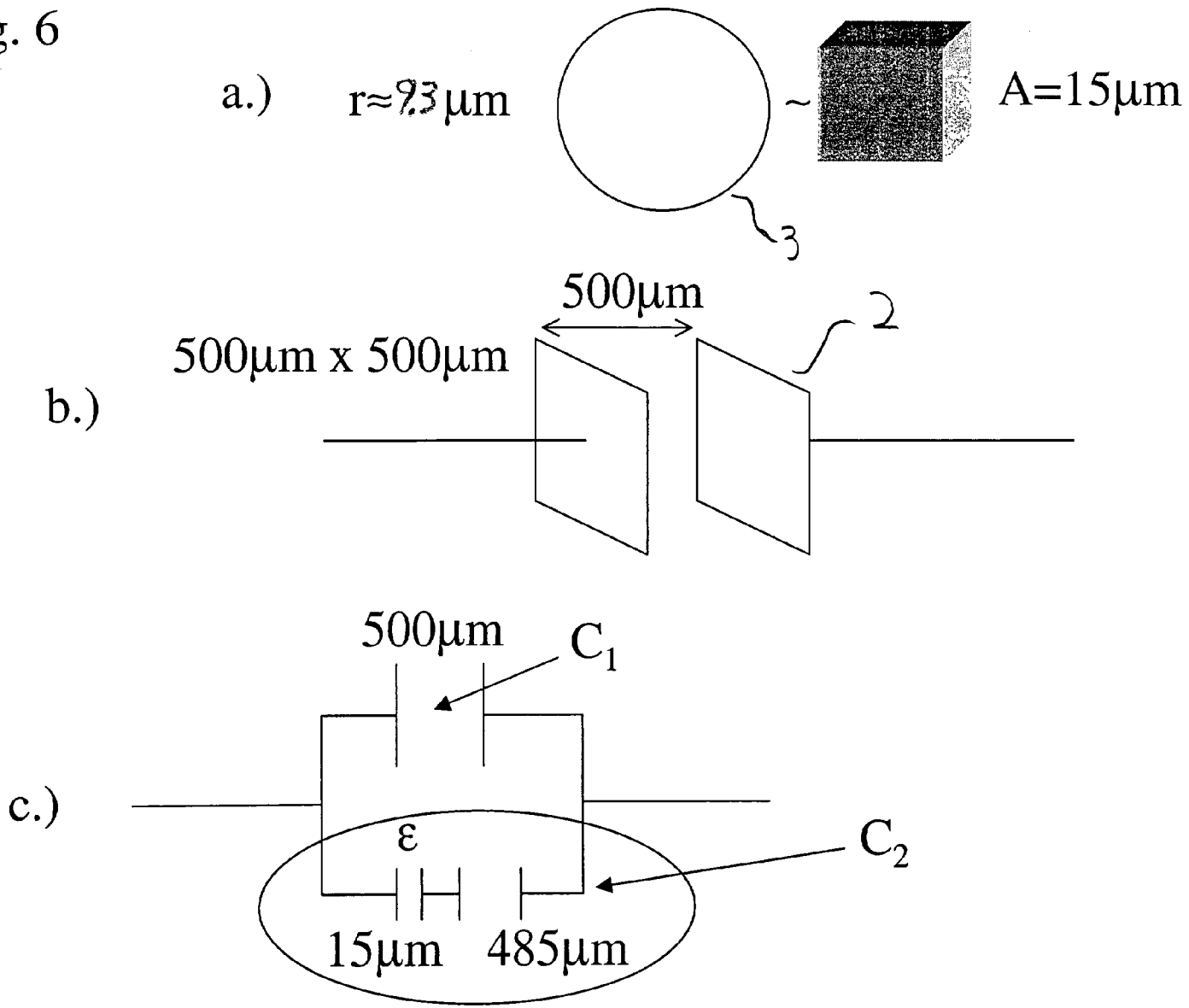
FIG. 6*a* is a diagram showing an example drop volume for an example of a preferred embodiment of the invention.
FIG. 6*b* is a diagram showing the dimensions of a plate capacitor used in an example of a preferred embodiment of the invention.
FIG. 6*c* is an electrical circuit diagram of a capacitor set-up for an example of a preferred embodiment of the invention.

The following is an example of numeric values that may be used in a typical application for a preferred embodiment of the invention. As shown in FIG. 6*a,* a sample droplet 3 having a dielectric constant of $\epsilon$=2.4 (which is typical for a solution having xylene as a solvent) and a radius of approximately 9.3 μm has approximately the same volume as a cube with 15 μm edges. Prior to droplet 3 entering a plate capacitor 2 (shown in FIG. 6*b* having two square plates of 500×500 $\mu m^2$ and plate separation of 500 μm), the capacitance of capacitor 2 is approximately:

$$C_1 \approx \epsilon_0 * 500\ \mu m = 4.4 * 10^{-15} F$$

wherein $\epsilon_0$ is the dielectric constant of a vacuum, which is substantially the same as the dielectric constant of air.

Once droplet 3 enters capacitor 2, the capacitance of capacitor 2 changes. One way of imagining the change in capacitance ($C_2$) is to envision the original capacitor $C_1$ in parallel with $C_2$, which is represented by two new capacitors in series, the first capacitor being a plate capacitor forming a cube with 15 μm sides (and having a dielectric constant of $\epsilon$=2.4) and the second one having two square plates of 15×15 $\mu m^2$ and plate separation of 500 μm (and having a dielectric constant of $\epsilon_0$). Thus, the capacitance of $C_2$ should be:

$$C_2 \approx \frac{1}{\frac{1}{\varepsilon * \varepsilon_0 * \frac{15\ \mu m * 15\ \mu m}{15\ \mu m}}} + \frac{1}{\frac{1}{\varepsilon_0 * \frac{15\ \mu m * 15\ \mu m}{485\ \mu m}}} \approx 4 * 10^{-18}\ \mathrm{F}$$

$C_2$ is actually the change in overall capacitance when droplet 3 passes through capacitor 2. If a voltage of 1 kV is applied to capacitor 2 at a frequency in the kHz range (which is a typical printing frequency and therefore could be easily provided by print head driver electronics 60, an overall current on the order of Picoamperes should be measurable. Assuming an expected signal-to-noise ratio of approximately 1, changes in the average drop volume on the approximate order of 1% can be measured (i.e. having a signal-to-noise ratio of approximately $10^{-2}$) using standard lock-in techniques.

In preferred embodiments using standard lock-in techniques, the dimensions of capacitor 2 is chosen to be small enough so that only one droplet is inside capacitor 2 at any one time. By way of example, for an application where the drop velocity is 1 m/s and the printing frequency is 1 kHz, the maximum dimensions for the edges of a cube-shaped plate capacitor is on the order of 1 mm.

With reference to FIGS. 7*a,* 7*b,* and 7*c,* a method for the manufacture of multiple capacitor sensor 2''' is shown. A first substrate (which is made of silicon in a preferred embodiment, but may comprise ceramics, plastic, or glass in alternative preferred embodiments by way of example only) 70 is provided, and it is coated 72 with photo-resist. The photo-resist is patterned 74 into channel lines. The parts of the substrate that are not covered with photo-resist are etched 75 to a depth which approximately corresponds to the desired separation of the plates of the capacitor. The bottom of the etched channels are metalized 76 (in a preferred embodiment, the metallization is by a directed beam from an anisotropic metalization source). A suitable metal, such as gold, silver, or aluminum is used, by way of example only.

Then, the photo-resist is removed 78 thereby finishing the creation of the first electrode(s).

A second glass substrate 80 is provided, and it is coated 82 with photo-resist. The photo-resist is patterned 84 into channel lines. The bottom of the etched channels are metalized 86. A suitable metal, such as gold, silver, or aluminum is used, by way of example only. Then, the photo-resist is removed 88 thereby finishing the creation of the second electrode(s).

The two electrode plates resulting after the photo-resist is removed 78 from the first glass substrate 70 and the photo-resist is removed 88 from the second glass substrate 80 are bonded into capacitor array 90. Leads or vias (not shown) are connected to the contact plates of capacitor array 90 to form multiple capacitor sensor 2'''. In a preferred embodiment, the bonding process uses epoxy or glass seal, though other bonding processes may be used in alternative preferred embodiments.

Using the method shown above, a capacitor sensor with many or few capacitors may be manufactured, including a capacitor sensor with only one capacitor, such as capacitor 2" shown in FIG. 3.

Figure 8:
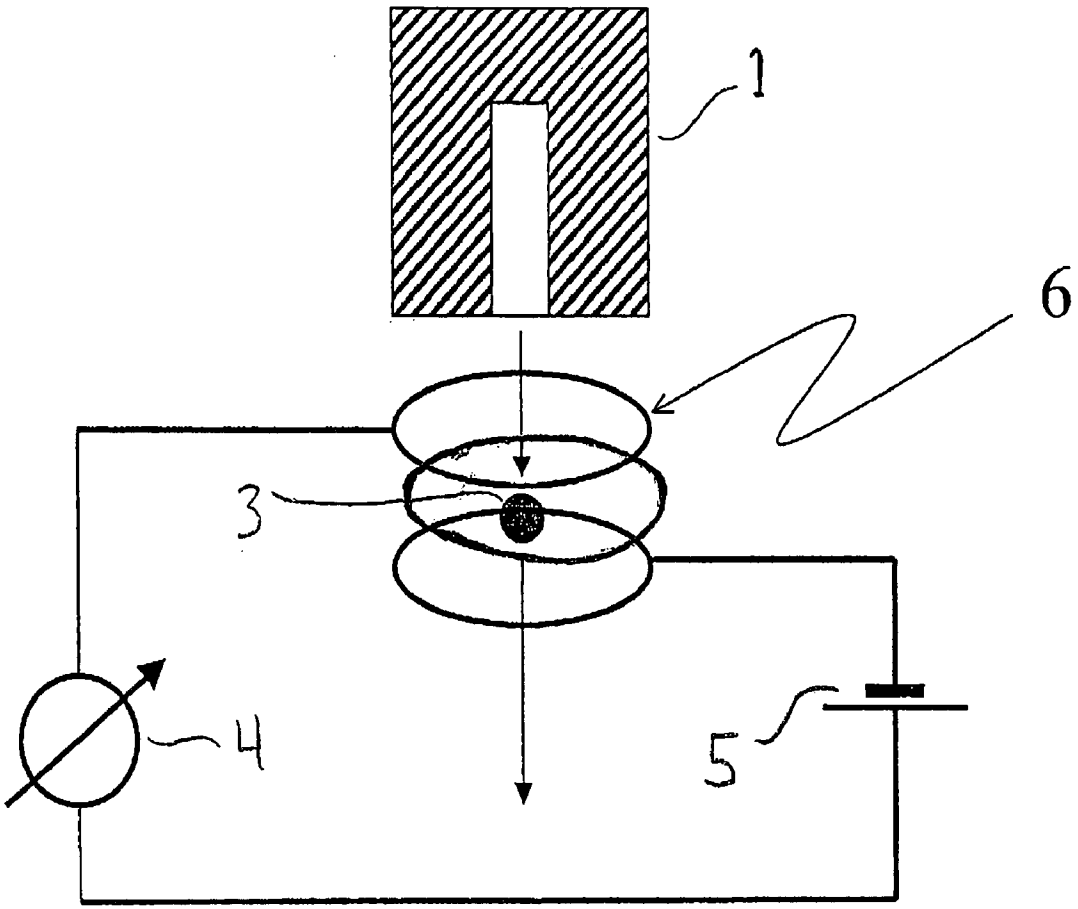
FIG. 8 is a diagram showing the use of an inductor in an apparatus that detects the change in inductance of the inductor due to the dielectric effect of an ink-jet droplet.

The preferred embodiments above used the dielectric properties of droplets to derive the drop volume. In alternative preferred embodiments, other electrical/magnetic characteristics of droplets, such as resistance, electrical charge, or magnetic properties are measured. For example, droplets may be given a charge (by way of example only, using a charged nozzle plate, which is known in the art of continuous ink-jet printing) or may contain ferromagnetic material Using an inductor (for example, a ring coil through which droplets travel) instead of a capacitor, the induced current may be measured and the drop volume or average drop volume obtained through detection of the change of current through the coil. FIG. 8 is a diagram showing the use of an inductor 6 (e.g., ring coil) in an apparatus that detects the change in inductance of the inductor 6 due to the dielectric effect of an ink-jet droplet. FIG. 8 shows a circuit similar to that shown in FIG. 1 except that the capacitor 2 of FIG. 1 is replaced with the inductor 6 in FIG. 8. Alternatively, the resistance of a droplet may be used to obtain the drop volume, though actual physical contact (by way of example only, two contact pads attached to the end of the nozzle) is needed to measure the resistance of a droplet.

While the invention has been described in terms of preferred embodiments, those skilled in the art will recognize that the invention can be practiced with modification within the spirit and scope of the appended claims.

The invention claimed is:

1. A method for determining a volume of at least one droplet, comprising:

a) emitting said at least one droplet from a print head through an electrical circuit; and b) detecting change in an electrical property within said electrical circuit due to said emitting said at least one droplet from said print head through said electrical circuit, the change being indicative of the volume of the at least one droplet;

wherein said electrical circuit is a plurality of capacitors or a plurality of inductors, wherein said plurality of capacitors or said plurality of inductors are fewer than a plurality of nozzles of said print head, and further comprising:

aligning said plurality of capacitors or said plurality of inductors with a subset of said plurality of nozzles.

2. The method for determining the volume of at least one droplet of claim 1, further comprising:

converting said change in an electrical property to said volume of said at least one droplet.

3. The method for determining the volume of at least one droplet of claim 1, wherein:

said emitting said at least one droplet from a print head through an electrical circuit comprises emitting said at least one droplet from a print head through a capacitor of said plurality of capacitors of said electrical circuit; and said electrical property within said circuit is the capacitance of said capacitor.

4. The method for determining the volume of at least one droplet of claim 3, further comprising:

bringing said at least one droplet to a desired charge prior to said detecting change.

5. The method for determining the volume of at least one droplet of claim 4, wherein said desired charge is substantial neutralization.

6. The method for determining the volume of at least one droplet of claim 1, wherein:

said emitting said at least one droplet from a print head through an electrical circuit comprises emitting said at least one droplet from a print head proximate to an inductor of said plurality of inductors of said electrical circuit; and said electrical property within said circuit is the inductance of said inductor.

7. The method for determining the volume of at least one droplet of claim 6, wherein said at least one droplet is given a charge prior to said detecting change.

8. The method for determining the volume of at least one droplet of claim 1, wherein said at least one droplet is a plurality of droplets.

9. The method for determining the volume of at least one droplet of claim 1, further comprising computing the average volume of a plurality of droplets, wherein said plurality of droplets includes said at least one droplet.

10. A method for printing the at least one droplet, comprising determining the volume of at least one droplet according to the method of claim 1, and concurrently printing at least part of an electrically active organic component.

11. A method for printing the at least one droplet, comprising determining the volume of at least one droplet according to the method of claim 1, and printing at least part of an electrically active organic component using said print head after the detecting step.

12. A method for printing the at least one droplet, comprising determining the volume of at least one droplet according to the method of claim 1 wherein:

said print head has a plurality of nozzles having an associated driver and said at least one droplet is a plurality of droplets; and the method of printing further comprises:

adjusting said associated driver for each of said plurality of nozzles based on said determining the volume of said at least one droplet; and using said print head to print at least part of an electrically active organic component subsequent to said adjusting.

13. An electrically active organic component manufactured according to the method of claim 1.

14. The electrically active organic component of claim 13 wherein said component is any one of: an OLED component, an organic solar cell component, an organic transistor component, or an organic detector component.

15. A metal line manufactured according to the method of claim 1.

16. A biological active component manufactured according to the method of claim 1.

17. A bio-chemical active component manufactured according to the method of claim 1.

18. A method for comparing an average volume of droplets emitted by a first nozzle with an average volume of droplets emitted by a second nozzle, comprising:

a) emitting a first set of droplets from said first nozzle through a first capacitor of an electrical circuit;

b) detecting change in an electrical property within said electrical circuit caused by dielectric or permeability characteristics of said first set of droplets from said first nozzle, wherein said change is a change of capacitance of said first capacitor;

c) emitting a second set of droplets from said second nozzle through a second capacitor of said electrical circuit;

d) detecting change in an electrical property within said electrical circuit caused by dielectric or permeability characteristics of said second set of droplets from said second nozzle, wherein said change is a change of capacitance of said second capacitor; and e) comparing said change in an electrical property within said electrical circuit due to said emitting said first set of droplets from said first nozzle through said electrical circuit with said change in an electrical property within said electrical circuit due to said emitting said second set of droplets from said second nozzle through said electrical circuit.

19. The method for comparing the average volume of droplets emitted by a first nozzle with the average volume of droplets emitted by a second nozzle of claim 18, further comprising adjusting the volume of subsequent sets of droplets emitted from at least one of said first nozzle and said second nozzle.

20. A circuit for determining a volume of at least one droplet, comprising:

a plurality of capacitors or a plurality of inductors situated proximate to a plurality of nozzles for emitting droplets;

a power source coupled to said plurality of capacitors or said plurality of inductors; and a current detector coupled to at least one of: (1) said plurality of capacitors or said plurality of inductors and (2) said power source, wherein said current detector reflects said volume of said at least one droplet, wherein said plurality of capacitors or said plurality of inductors are fewer than said plurality of nozzles.

21. The circuit of claim 20, further comprising means for computing the average volume of a plurality of droplets, wherein said plurality of droplets includes said at least one droplet.

22. The circuit of claim 20, further comprising circuitry for comparing said volume of at least one droplet to the volume of another at least one droplet.

23. The circuit of claim 20, further comprising circuitry to provide feedback to print head driver electronics to cause said print head driver electronics to adjust the volume of subsequent droplets emitted from a particular one of said plurality of nozzles.

24. The circuit of claim 23, wherein said circuitry to provide feedback to print head driver electronics comprises a lock-in amplifier.

* * * * *